United States Patent [19]

Lemp

[11] Patent Number: 4,527,019

[45] Date of Patent: Jul. 2, 1985

[54] MICROPHONE HANGER

[76] Inventor: William M. Lemp, 117 Wolf Ave., Englewood, Ohio 45322

[21] Appl. No.: 622,617

[22] Filed: Jun. 20, 1984

[51] Int. Cl.[3] ..... H04R 1/00; H04R 1/20

[52] U.S. Cl. ..... 179/146 R; 179/149; 179/153; 248/324; 381/91

[58] Field of Search ..... 179/146 R, 149, 150, 179/153, 178, 179; 381/87, 91; 248/324

[56] References Cited

U.S. PATENT DOCUMENTS

| | | | |
|---|---|---|---|
| 1,887,637 | 11/1932 | Hansen | 179/146 R |
| 1,942,925 | 1/1934 | Jenkins | 179/146 R |
| 2,129,898 | 9/1938 | Wright | 179/150 |
| 2,235,505 | 3/1941 | Ryan | 179/146 R |
| 2,235,518 | 3/1941 | Goshaw | 179/146 R |
| 3,155,780 | 11/1964 | Burroughs | 179/146 R |
| 4,475,226 | 10/1984 | Greenberg | 381/87 |

FOREIGN PATENT DOCUMENTS

| | | | |
|---|---|---|---|
| 652924 | 11/1962 | Canada | 248/324 |
| 1336847 | 11/1973 | United Kingdom | 179/146 R |

*Primary Examiner*—Gene Z. Rubinson
*Assistant Examiner*—Danita R. Byrd
*Attorney, Agent, or Firm*—Biebel, French & Nauman

[57] ABSTRACT

A microphone hanger, which permits a microphone attached to it to be directed at various sound sources in a studio, auditorium, church or other environment, includes a cylindrical base having a disc-shaped top wall carrying a socket for a vertically depending microphone cable, and a disc-shaped bottom wall slidably received within said base for rotation about its longitudinal axis. The rotatable bottom wall carries a microphone mount for rotation with the bottom wall, and an opening is formed in the bottom wall to accommodate a cable extending from the socket to a microphone carried by the microphone mount.

9 Claims, 5 Drawing Figures

MICROPHONE HANGER

BACKGROUND OF THE INVENTION

Conventionally, microphones are suspended from a vertically depending cable and the microphone pointed in the direction of a sound source which it is desired to pick up by attaching lines to the microphone and twisting the microphone and the cable from which it is suspended to the desired orientation. This is obviously time consuming and can interfere with movement in the vicinity of the microphone.

Another approach is to use an omnidirectional microphone of the type shown, for example, in U.S. Pat. No. 4,178,155. With this type of sound pick up, there is no need to direct the microphone towards a sound source, since all sounds within 360° around the microphone will be received equally. However, it is often desired to pick up sounds only from a single source or sources while eliminating sounds from other sources. Obviously, this cannot be accomplished with an omnidirectional microphone.

It is desirable, therefore, to have a directional microphone mount that can be focused toward a single source of sound which it is desired to receive while eliminating pick up from undesired sources and without the necessity of external ties to point the microphone in a desired direction.

SUMMARY OF THE INVENTION

The present invention provides a directional microphone hanger which can quickly and easily be directed towards a desired source of sound without the necessity of external ties to hold the microphone in the desired position.

The directional microphone hanger of the present invention includes a substantially cylindrical base member having a fixed, disc-shaped top wall which in turn carries an audio jack which may be of conventional construction.

The cylindrical base member also carries a disc-shaped bottom wall which is mounted for slidable rotation with respect to the cylindrical base member about the longitudinal axis thereof.

The bottom wall also carries for rotation which it a microphone mount, which may be of conventional design, and a connecting cable is provided extending from the top plate mounted audio jack down through the cylindrical member and through an opening formed in the bottom wall to be attached to a microphone carried by the microphone mount.

Preferably, the rotatable bottom wall is mounted between a pair of spaced, inwardly projecting annular flanges secured to an inner surface of the cylindrical base member and defining an annular track receiving the periphery of the bottom wall.

While the opening through the bottom wall for accommodating the cable extending from the audio jack to the microphone carried by the microphone mount may simply be an opening large enough in diameter for the cable to pss through it, preferably the opening is of arcuate configuration, thereby decreasing the amount of movement that the cable undergoes as the microphone mount is rotated to decrease the stress on and possible breakage of the connection between the upper end of the cable and the socket carried by the disc-shaped top wall.

DESCRIPTION OF THE PREFERRED EMBODIMENT

Figure 1:
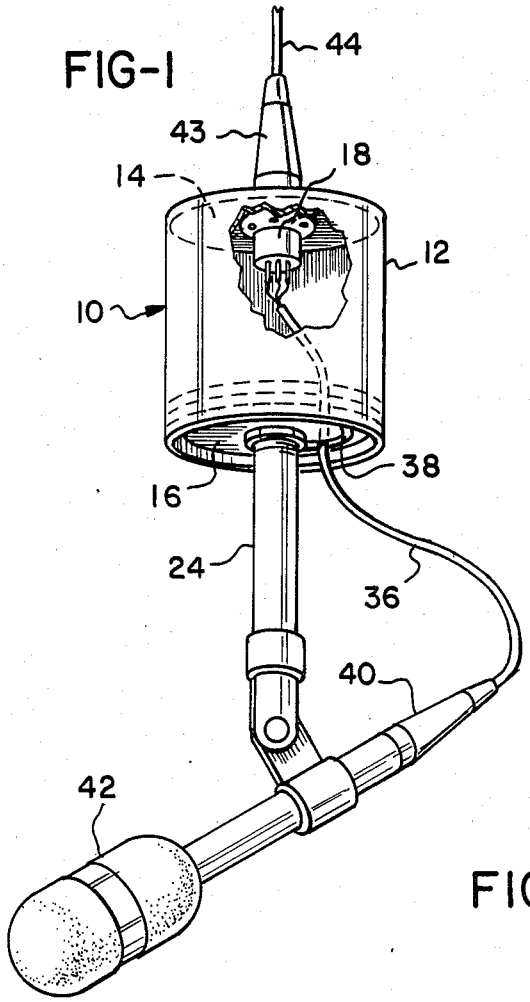
FIG. 1 is a perspective view of the microphone hanger of the present invention.
Figure 3:
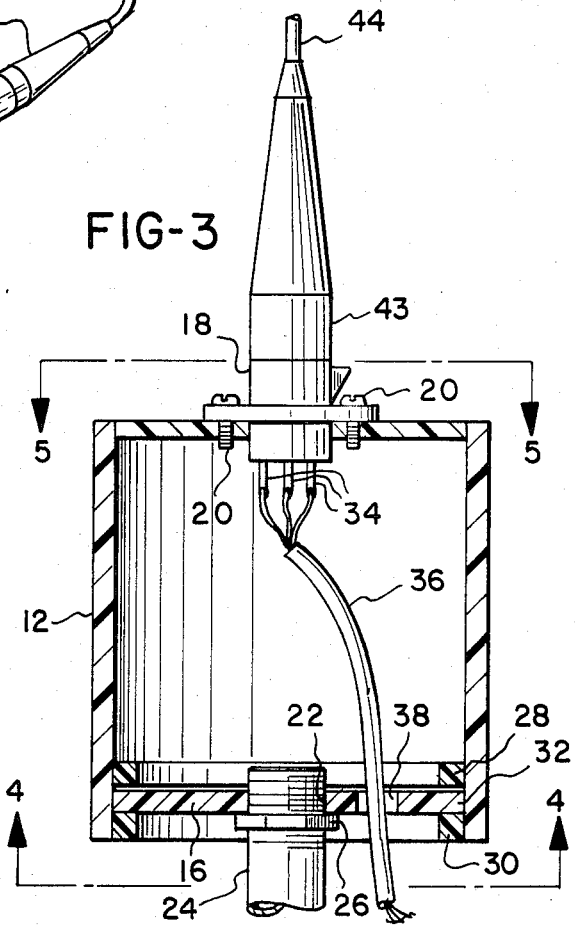
FIG. 3 is a side view, partially in section, of the microphone hanger.

A microphone hanger 10 in accordance with the present invention includes a substantially cylindrical base member 12 having a disc-shaped top wall 14 fixed to its upper end and a disc-shaped bottom wall 16 slidably mounted at its lower end for rotation about its longitudinal axis.

The top wall 14 carries a standard audio jack 18, which may be attached to the top wall by means of screws or the like 20.

The rotatable bottom wall 16 has a threaded opening 22 to receive a comlementarily threaded end of the microphone mount 24, and a lock nut 26 may also be provided to fix the microphone mount against rotation with respect to the bottom plate 16.

Rotational mounting of the bottom plate 16 with respect to the base member 12 is attained through the use of a pair of spaced annular flanges 28 and 30 which are fixed to an interior surface of the base member 12 to define an annular trackway 32 receiving the periphery of the plate 16 for rotatable movement thereof with respect to the base member 12.

Figure 4:
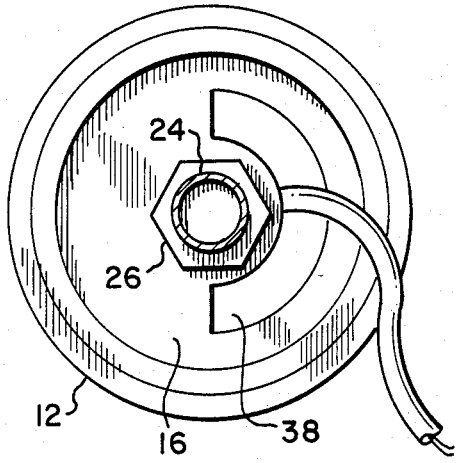
FIG. 4 is a bottom view taken on line 4—4 of FIG. 3.
Figure 5:
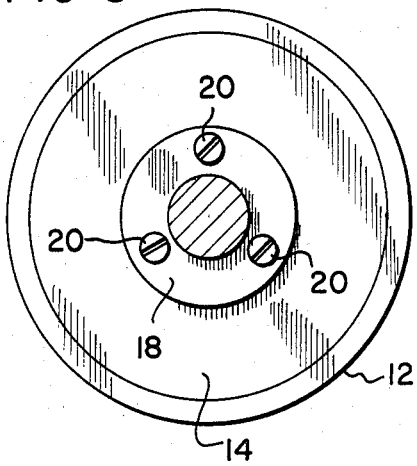
FIG. 5 is a top view taken on line 5—5 of FIG. 3.
Figure 2:
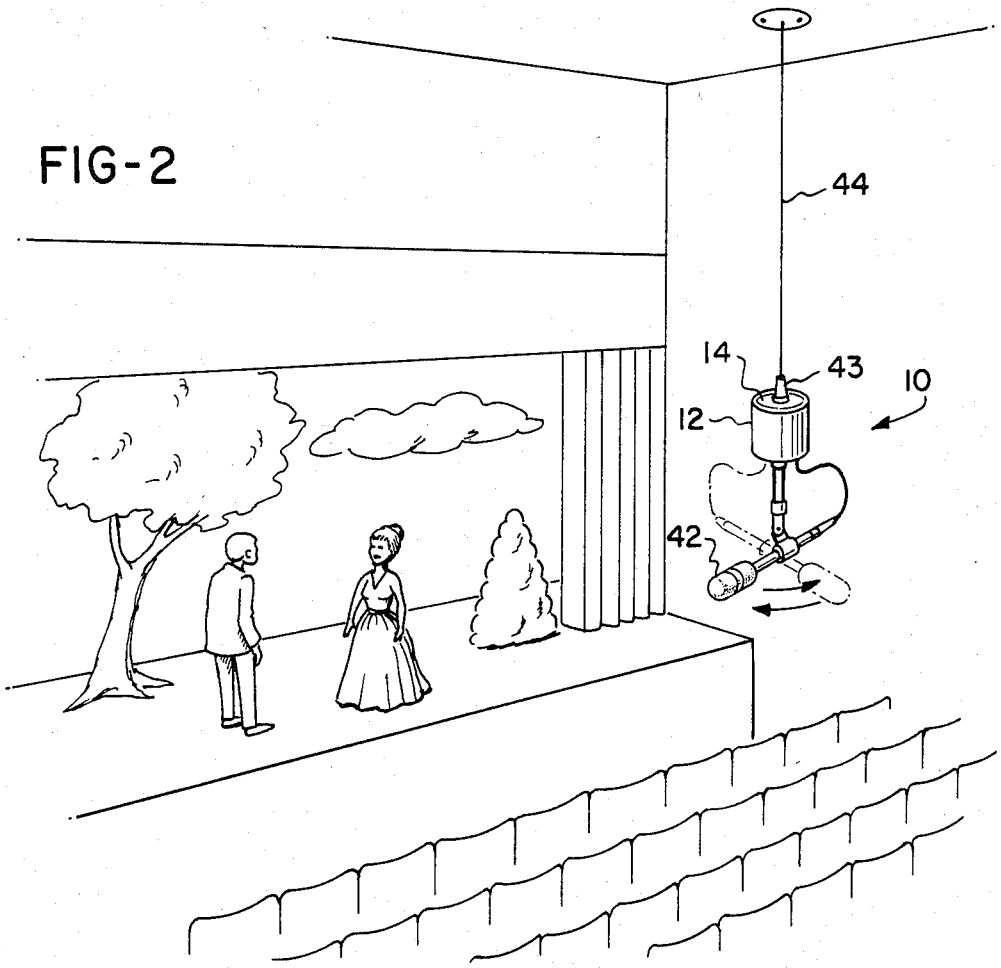
FIG. 2 is a second perspective view on a somewhat smaller scale showing the microphone hanger in use.

Attached to inwardly projecting terminals 34 of the jack 18 are the leads of a cable 36 which extends from the jack 18 downwardly through the cylindrical member 12 and thence out through an opening 38 formed in the rotatale bottom wall. Cable 36 then terminates at its lower end in a conventional jack 40 for connection to the base of a directional microphone 42 carried by the mount 24. As best seen in FIG. 4 of the drawings, the opening 38 is preferably of arcuate construction for a purpose presently to be described.

In operation, the jack 18 receives and establishes an electrical connection with the complementary jack 43 attached to the lower end of a vertically depending microphoen cable 44. The audio engineer then determines the location of the sound it is desired to pick up on the microphone 42, and by moving the rotatable bottom wall 16, rotates the microphone in that direction. By forming the opening 38 as an arcuate slot, movement of the cable 36 with respect to the jacks 34 when the microphone 42 is rotated is kept to a minimum, thereby alleviating stress and possible disconnection at the leads 34.

Cylindrical base member 12, top plate 14, bottom plate 16 and annular flanges 28 and 30 may conveniently be formed from a transparent plastic material such as an acrylic resin, thereby decreasing its visibility if this is desired.

Alternatively, and particularly where more than one microphone is used to pick up different sources of sound, the microphone hanger may be color-coded to assist the audio engineer in determining which microphones are picking up which sounds.

From the above, it will be seen that the present invention provides a relatively simple, yet effective mechanism for orienting a directional microphone in a desired direction, without the necessity of external ties, lines and similar devices.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A directional microphone hanger comprising:

a base member, said base member having a top wall attached thereto, an audio jack attached to said top wall, a bottom wall disposed beneath said top wall and slidably mounted on said base member for rotation with respect thereto through 360°, a microphone mount attached to and projecting downwardly from said bottom wall, a directional microphone mounted on said microphone mount and disposed entirely beneath said base member and said bottom wall thereof, and cable means interconnecting said audio jack and said directional microphone.

2. The hanger of claim 1 wherein said bottom wall comprises a plate member rotatably mounted on said base member.

3. The hanger of claim 2 wherein said plate member is substantially disc-shaped.

4. The hanger of claim 2 further comprising means defining an opening through said plate member, and said cable means extends from said audio jack through said opening.

5. The hanger of claim 1 wherein said base member is substantially cylindrical.

6. The hanger of claim 4 wherein said opening is arcuately shaped.

7. The hanger of claim 1 wherein said hanger is formed of clear plastic.

8. The hanger of claim 1 wherein said hanger is color-coded.

9. A directional microphone hanger comprising:

a substantially cylindrical base member, a disc-shaped top wall mounted on said cylindrical base member, socket means attached said top wall for attachment to complementary socket means on a microphone cable, spaced annular flanges projecting inwardly of said cylindrical base member and defining an annular track within said cylindrical base member, a disc-shaped bottom wall slidably mounted within said annular track for rotational movement about a longitudinal axis of said cylindrical base member, a microphone mount carried by said bottom wall for rotation therewith, means defining an arcuate opening through said bottom wall, and cable means extending from said socket means carried by said top wall through said base member and said arcuate opening adjacent said microphone mount.

* * * * *